US007310868B2

(12) United States Patent
Philbrook

(10) Patent No.: US 7,310,868 B2
(45) Date of Patent: Dec. 25, 2007

(54) METHOD FOR CREATING DECORATIVE STONE/SHELL COMPOSITE FLATWARE HANDLE

(76) Inventor: Tamra Philbrook, 68 Dartmouth St., Old Town, ME (US) 04468

( * ) Notice: Subject to any disclaimer, the term of this patent is extended or adjusted under 35 U.S.C. 154(b) by 0 days.

(21) Appl. No.: 11/391,533

(22) Filed: Mar. 28, 2006

(65) Prior Publication Data

US 2006/0165907 A1 Jul. 27, 2006

Related U.S. Application Data

(62) Division of application No. 10/794,585, filed on Mar. 5, 2004, now abandoned.

(51) Int. Cl.
*B21B 1/46* (2006.01)

(52) U.S. Cl. ..... 29/527.2

(58) Field of Classification Search ..... 29/527.2, 29/527.1, 428; 427/402, 180, 372.2, 307
See application file for complete search history.

(56) References Cited

U.S. PATENT DOCUMENTS

| | | | | |
|---|---|---|---|---|
| 3,271,856 | A * | 9/1966 | Rowley | 30/343 |
| 4,521,356 | A | 6/1985 | Keller et al. | |
| 5,475,894 | A | 12/1995 | Wildforster | |
| 2004/0194875 | A1 * | 10/2004 | Lee | 156/230 |

* cited by examiner

*Primary Examiner*—John C. Hong

(57) ABSTRACT

A method of creating flatware having a decorative handle comprised of a composite of stone and/or shell and a resin, the method being preparation of the raw materials, reducing the stone and/or shell to particulates and embedding same within a transparent or translucent resin to form the handle, successive applications of resin and particulate to the flatware to build up the handle, shaping the handle to the desired final shape, and creating a finish for the final product, such that the particulates comprising the handle are visible yet protected within the resin.

21 Claims, 4 Drawing Sheets

METHOD FOR CREATING DECORATIVE STONE/SHELL COMPOSITE FLATWARE HANDLE

CROSS REFERENCE TO RELATED APPLICATION

This application is a divisional of U.S. Ser. No. 10/794,585, filed Mar. 5, 2004 now abandoned and currently pending in Art Group 3725, entitled Decorative Stone/Shell Composite Flatware Handle And Method For Creating Same, which is hereby incorporated by reference.

BACKGROUND OF THE INVENTION

1. Technical Field

The invention relates generally to flatware and more particularly to a method for creating flatware incorporating stone and shell accents into the handle to create a utensil with a decorative appearance.

2. Description of Prior Art

Decorative flatware is well known in the art. Flatware having a decorative handle component, which handle is formed of material separate from the remaining portion of the flatware, is also well known. Such handles may be formed of wood, plastic, ceramic, and other materials. For example, U.S. Pat. No. 4,521,356 (Keller, et al.), discloses a decorative flatware handle and a process for its preparation, whereby the handle is made of ceramic. In such cases, the handle is formed by a process, then attached to the flatware. The present invention materially differs from such prior art in that a separate handle is not prepared and then attached, but rather the handle is formed onto the flatware in stages, in a multi-step process.

The current invention utilizes "natural" items for the decorative aspect of the flatware handle. These "natural" items are crushed shell or crushed stone, though the stone may be synthetic (provided it is evocative of natural stone). Rather than painting, carving, forming into the surface, or otherwise representing shell and/or stone on the handle, as is done in the prior art, the present invention incorporates physical pieces of same within the flatware handle. This incorporation of actual "natural" elements into the flatware increases the attractiveness of the finished product to consumers. The prior art discloses the use of embedded organic or inorganic substances bonded to tool handgrips, see U.S. Pat. No. 5,475,894 (Wildforster), but said invention requires the bonded substances to extend beyond the handle surface so as to provide improved gripping regions. The present invention differs materially from Wildforster in that it is directed to a smooth handle without providing protuberances for improved gripping regions, with the embedded particulates fully contained within the handle and below the surface thereof. As such, the handle of the instant invention is required to be formed of a material which allows the visible display, at least in part, of the embedded particulates. Transparent or translucent materials therefore may be used to contain the particulates, but not opaque materials. Moreover, the instant invention requires the selection of organic or inorganic substances based on aesthetic effect. No known prior part discloses this combination of design features.

SUMMARY

The invention is directed to a method of creating flatware having a formed handle, said handle being a composite of a resin and particulates of stone and/or shell. The stone and/or shell particulates are embedded within the resin and bonded therewith to the flatware and/or to each other. The resin is transparent or translucent, thereby permitting the particulates to be viewed, at least in part, through the surface of the handle.

The method of creating the flatware involves preparing the materials, applying the materials in layers in an iterative process, and then finishing the handle through a process of shaping, coating, and polishing. The iterative nature of the method, combined with the substantial time delay between each iteration, does not easily lend itself to commercial applications or assembly-line production, but rather is intended to be utilized by craftsmen and artists.

The materials incorporated in the handle are indigenous to New England and especially to coastal areas, and its use in flatware is highly desirable to a significant population of purchasers. The preparation of the materials includes the selection of aesthetically pleasing stone and/or shell. It is selected for its color, shape, texture, light reflecting properties, and the like. Once selected, the materials are cleaned, if necessary, then reduced to particulates. The size of the particulates is dictated by the aesthetics of the end result, though for practical purposes the particulates should fall within a certain range to avoid overly large or overly small pieces. The application process consists of iterative layering of resin and particulates, the resin serving to bond the particulates to the flatware and to each other. The resin also serves to fill in irregularities formed along the surfaces of the particulates, so that the surface of the handle is substantially smooth.

It is an object of this invention to provide a process for creating flatware having incorporating into the handle thereof the natural beauty of stone and/or shell by inclusion of physical particulates of same therein.

Other features and advantages of the invention are described below.

DETAILED DESCRIPTION OF THE INVENTION

Figure 1:
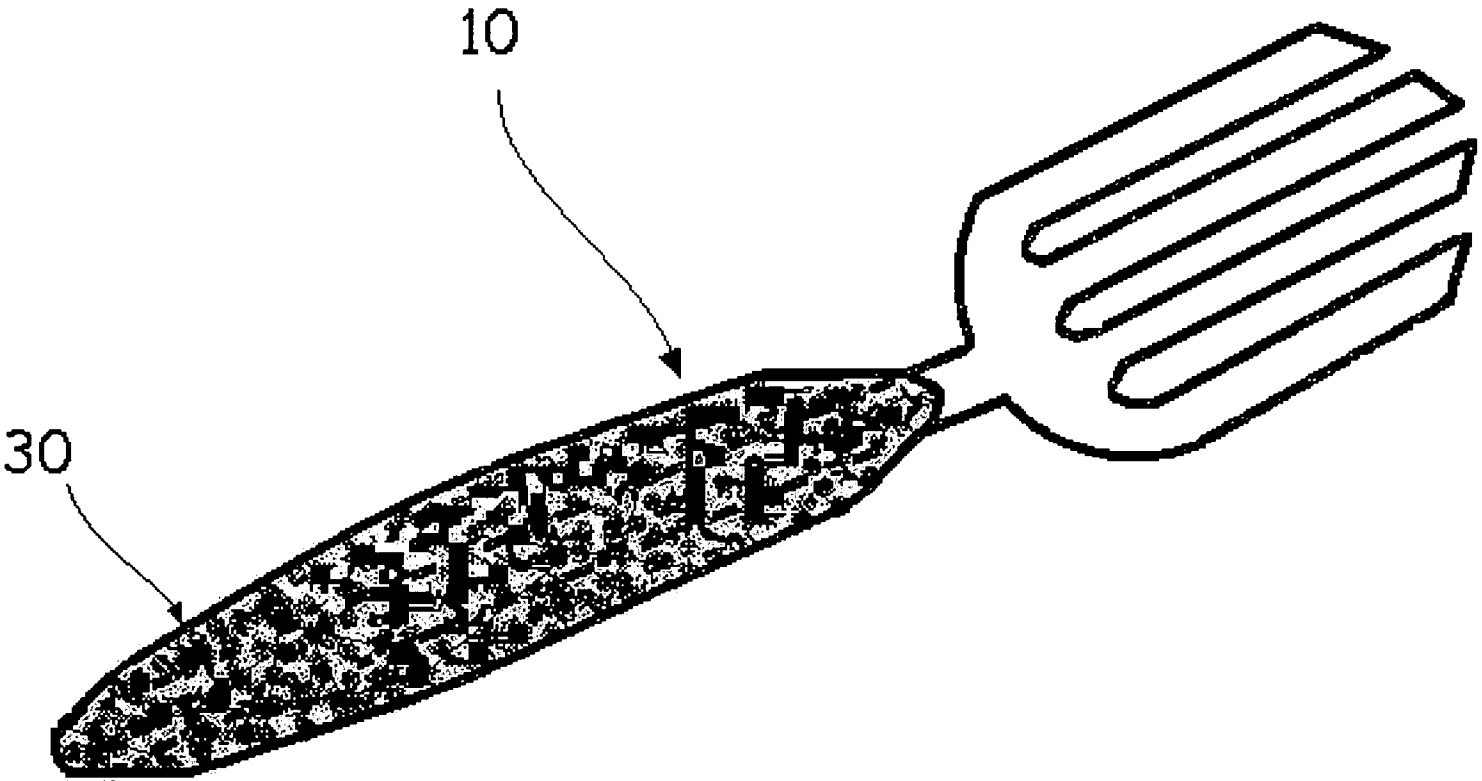
FIG. 1 is a perspective view of the flatware with a decorative handle.
Figure 2:
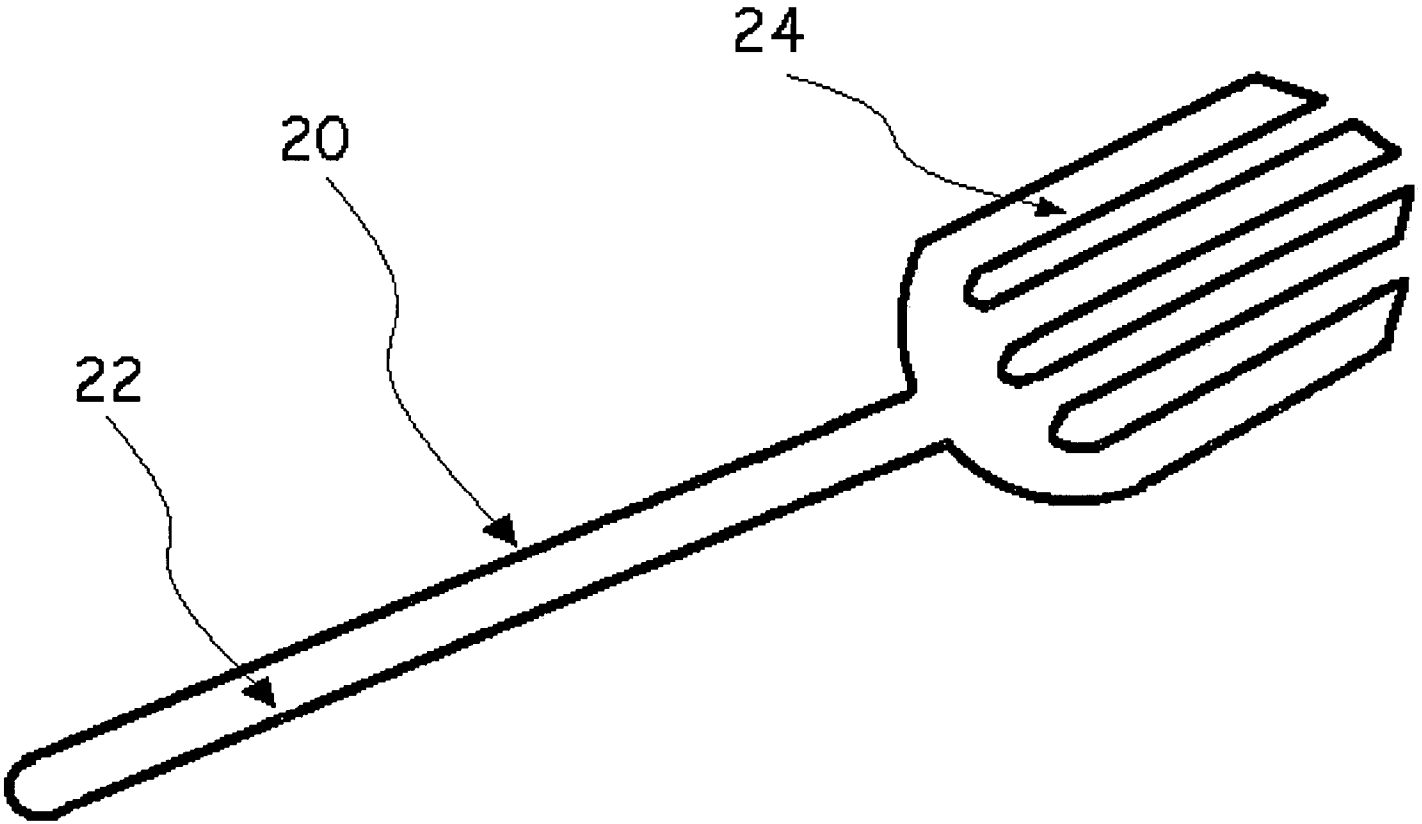
FIG. 2 is a perspective view of the flatware core showing the shaft and the working end, without showing the handle.
Figure 3:
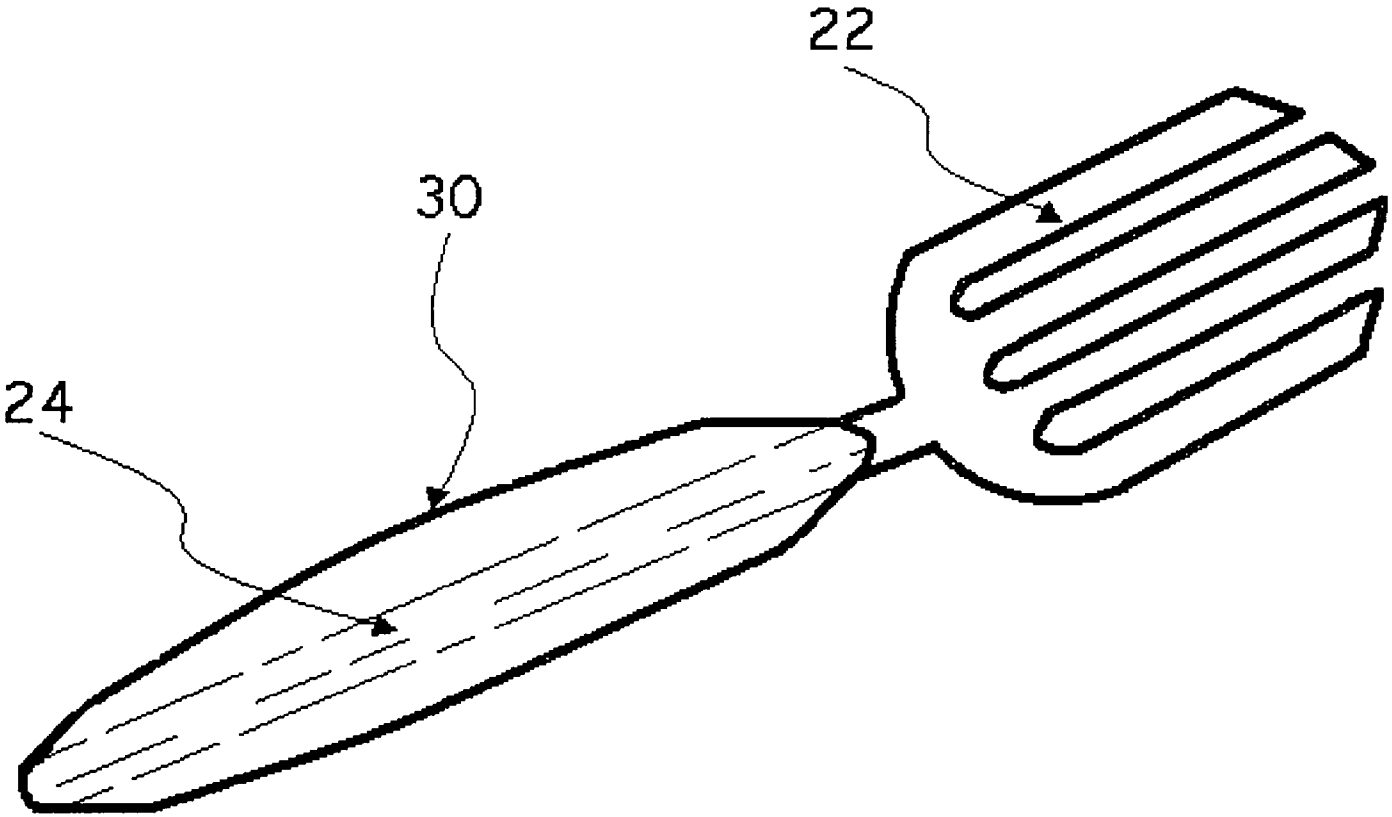
FIG. 3 is a cut-away view of the handle and a broken-line view of the shaft of the flatware core showing the relationship of the handle to the shaft.
Figure 4:
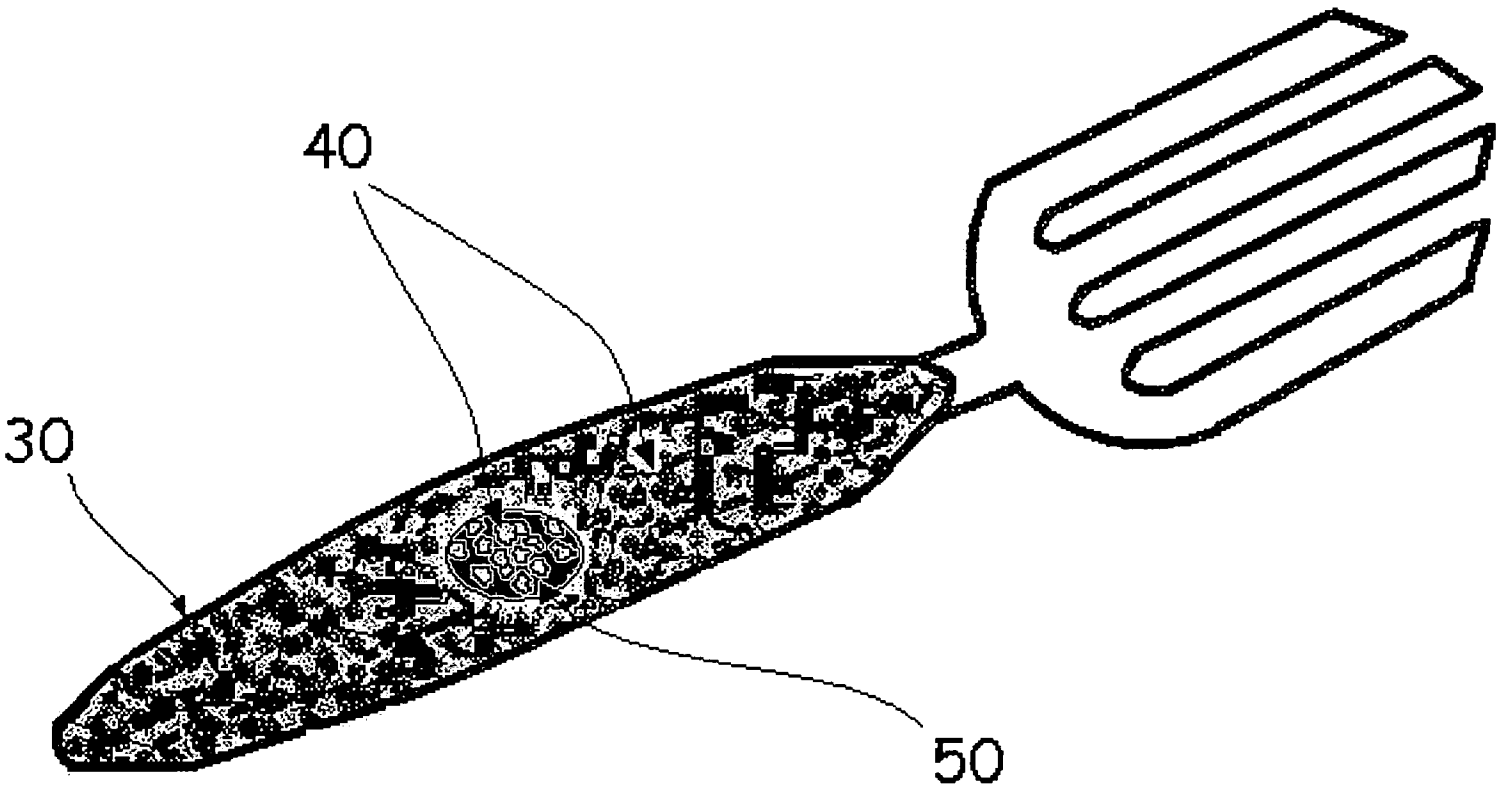
FIG. 4 is a perspective view of the flatware with a partial stylized view of the handle to better show the individual inclusions and the resin into which they are embedded.

The invention is directed to a method of creating flatware 10 having a handle 30 consisting of a composite of a resin 50 and organic and/or inorganic inclusions 40. The inclusions 40 are more specifically contemplated to be formed from stone or from shell, with the stone being primarily granite quarried from New England and the shell being primarily crustacean and mollusk shells harvested from the coast of New England. The use of naturally occurring materials originating from the New England coast distinguishes the finished product from other flatware available for purchase.

In order to render the selected raw material suitable for use as inclusions 40 in the handle 30, the raw material is reduced to particulates, and the particulates are embedded in the resin 50 and bonded to the flatware 10, forming a handle 30 thereto. The particulates must fall within a range of sizes suitably adapted to allow them to be embedded within the handle 30 while still providing an aesthetically pleasing visual effect (that is, the particulates cannot be so large as to prevent appropriate incorporation into the handle 30, and not so small as to lose the ability to convey the desired color, shape, texture, and other desired aesthetic characteristics). The flatware 10 may be any type of utensil commonly used for tableware, such as a fork, a spoon, a knife, and variations thereon. Other food preparation and/or serving tools such as tongs, peelers, skewers, picks, and the like are also contemplated within the definition of flatware. The flatware 10 must be of the general design of having a core 20 and a handle 30, the core 20 having a working end 22 and a shaft 24 extending therefrom, said shaft 24 being suitably adapted to accommodate the handle 30, said handle 30 being fixedly attached to the shaft 24. The working end 22 of the core 20 may be the tines of a fork, the bowl of a spoon, the blade of a knife, and the like. The core 20 may be constructed of any suitably rigid material, such as metal, metal alloy, plastic, wood, or the like. In the preferred embodiment the core 20 is constructed of stainless steel.

The resin 50 comprising the handle may be an epoxy or a polymer. The resin 50 should be water resistant, and preferably is waterproof. Transparent resins are preferred, though translucent resins may also be used. The resin should be durable, able to resist scratching, denting, chipping, or breaking during normal use of flatware. The resin should also have a relatively short curing time, or be susceptible to accelerated curing, for example by subjecting it to heat or accelerating additives. The preferred resin 50 is an epoxy, and the preferred type of epoxy is jeweler's epoxy. An example of the preferred epoxy is West System™ Epoxy 330, which is well known in the art for its excellent bonding characteristics and ability to harden is a matter of hours, or quicker if heat is applied or if accelerators are used. The resin 50 may also incorporate a finishing resin, such as marine epoxies, which are water proof. An example of the preferred finishing resin is West System™ Epoxy 105/207.

The inclusions 40 are comprised of stone and/or shell. Shell may be clam shell, oyster shell, lobster shell, crab shell, mussel shell, or any other type of mollusk or crustacean shell. Stone may be natural stone, preferably granite, or synthetic stone having the appearance of natural stone. Shell and/or stone is selected for its aesthetic appearance, including color, texture, and light reflective properties.

The flatware 10 has a rigid transparent or translucent handle 30, through which the particulates can be observed, imparting a decorative look to the flatware 10. The handle 30 itself may have any desirable shape, and need not be symmetrical along its length or circumference. The surface of the handle 30 should be substantially smooth, without sharp protrusions or cracks thereon. The portion of the flatware 10 apart from the handle 30 may have a matte finish. The choice of inclusions 40 may be customized to allow the flatware 10 to match other tableware, countertops, kitchen or dining room decor, and the like.

The method of creating flatware 10 as described above involves, broadly, the steps of selecting appropriate materials to be used as inclusions 40; cleaning and then reducing the materials to particulates by crushing, grinding, pulverizing, or the like, with the resulting particulates being of various shape and size, though the particulates should be smaller in diameter than 0.25 inches and large enough so as not to pass through a No. 20 sieve, U.S. Standard Sieve Series (openings of 0.0331 inches); building up the handle 30 by successively layering resin 50 and inclusions onto the flatware core 20; shaping the handle 30 to the desired shape; and finishing the flatware 10 by polishing, buffing, cleaning, and the like.

The method for creating said decorative flatware 10 more specifically comprises the following steps:

1. Selecting the raw materials for the inclusions 40.
2. Cleaning the raw materials. If the raw materials are shell-based, cleaning the shell material by one or more of the following processes, as needed, by:
   a. physically separating shell material from non-shell material;
   b. washing the shell material with water;
   c. sterilizing the shell material, by applying one or more of the following to it:
      i. bleach;
      ii. ammonia;
      iii. other cleaning solvent; and
   d. drying the shell material, by one of the following methods:
      i. heat drying in an oven;
      ii. heat drying by heat lamps;
      iii. heated air drying; or
      iv. unheated air drying.

If the raw material is stone, cleaning may simply involve rinsing with water or removing dust by wiping the stone or by blowing air over it. Particularly dirty stone may be cleaned in the same manner as shell material. Raw materials may be already clean when obtained and therefore no additional cleaning may be required.
3. Reducing the raw materials to particulates having the desired size by the following process:
   a. manually crushing the raw materials with hammers, mauls, mortar and pestle, or similar crushing devices, or mechanically crushing the raw materials using stone crushers, grinders, or the like; and
   b. screening the particulates for desired size by passing them through screens or sieves. Multiple screens may be used, with at least one screen having openings representing the largest desired size of the particulates and one screen having openings representing the smallest desired size of the particulates. A single screen may also be used. Particulates exceeding the maximum desired size may be reprocessed by repeating step 3. Particulates having a size smaller than the minimum desired are discarded. Step 3 may be omitted if the raw material was previously reduced to particulates having the desired size (for example, in step 1, crushed stone already having the desired size may be selected).
4. In the preferred embodiment, preparing the core 20 of the flatware 10 for processing by covering the working end 22 of the core 20 with tape, foil, plastic, or other removable protective material. In other embodiments this step may be eliminated. This step may be performed at any time in relation to steps 1 through 3 and 5.
5. Preparing the resin 50 for application onto the core 20 of the flatware 10. In the preferred embodiment, an epoxy resin is prepared by mixing the epoxy with a hardener in the appropriate proportions. West System™ Epoxy 330 is an example of a suitable epoxy. In other embodiments, a non-epoxy resin is prepared for application by any suitable means known in the art whereby the resin is rendered semisolid and capable of receiving and bonding to particulates. The step of preparing the resin 50 may be performed at any time in relation to steps 1 through 4, provided the resin 50 is not allowed to harden before step 6 is performed. In the preferred embodiment step 5 is performed just prior to step 6.

6. Creating the handle 30 by performing the following three sub-steps, in sequence:
   a. Applying a first layer of resin to the shaft 24 of the core 20 of the flatware 10. The resin 50 may be applied to the shaft 24 by a brush, or the resin 50 may be sprayed onto the shaft 24, or the shaft 24 may be dipped into the resin 50, or the resin 50 may be applied to the shaft 24 by any other suitable means.
   b. Applying a first layer of particulates onto the first layer of resin, such that the particulates bond to the core 20 and become embedded at least in part within the resin 50. The first particulate layer may be applied by distributing particulates onto the first resin layer by dropping them thereon, or by placing particulates thereon, or by rolling the shaft 24 of the core 20 in the particulates, or by any other suitable means.
   c. Curing the first layer of resin, whereupon the resin 50 becomes rigid and the particulates are fixedly attached thereto. In the preferred embodiment, the core 20 of the flatware 10 is suspended from its working end 22 such that the first layer of resin does not contact any surface, other than the core 20, and the resin 50 is permitted to harden over time. This may require a period of several hours if no heat or accelerants are used. In other embodiments, heat may be applied to speed the curing process. In yet other embodiments, accelerating additives may be mixed with the resin 50 to speed the curing process. In yet other embodiments both heat and accelerating additives may be used to speed the curing. Additionally, the core 20 need not be suspended, but may be inserted into a rack or other device suitably adapted to keep the first resin layer from contacting other surfaces.
7. If desired, the following four sub-steps may be performed, in sequence, any number of times, with the preferred embodiment having the following sub steps repeated three times:
   a. Preparing additional resin 50 for application onto the handle 30.
   b. Applying another layer of resin to the handle 30. The resin 50 may be applied to the handle 30 by a brush, or the resin 50 may be sprayed onto the handle 30, or the handle 30 may be dipped into the resin 50, or the resin 50 may be applied to the handle 30 by any other suitable means.
   c. Applying another layer of particulates onto the layer of resin, such that the particulate bonds to and becomes embedded at least in part within the resin 50. The particulate layer may be applied in the same manner as described above.
   d. Curing the layer of resin, in the same manner as described above.
8. In the preferred embodiment, the following three sub-steps are performed, in sequence. In other embodiments these steps may be omitted.
   a. Preparing the resin 50 for application onto the handle 30.
   b. Applying a final resin layer to the handle 30. The resin 50 may be applied to the handle 30 by a brush, or the resin 50 may be sprayed onto the handle 30, or the handle 30 may be dipped into the resin 50, or the resin 50 may be applied to the handle 30 by any other suitable means. The final resin layer should cover any particulates extending beyond the surface of the prior layer of resin, such that gaps, crevices, or cracks formed into the surface of the handle 30 are filled in by resin 50.
   c. Curing the final layer of resin, in the same manner as the first layer of resin was cured. Curing times may be extended, as needed, to ensure complete hardening of the resin 50.

Step 8 may be repeated as desired to complete coverage of any particulates extending from any other layer of resin, so that a substantially smooth surface of the handle 30 is achieved.
9. Shaping the handle 30 to its desired final shape. This may be done by any combination of coarse and fine sanding, grinding, and/or cutting, using appropriate manual or mechanical sanding, grinding, or cutting devices, such as belt sanding machines, lathes, dremel tools, saws, exacto knives, and the like. In addition to achieving its final shape, the sanding, grinding, and/or cutting serves to remove excess resin 50 and to reduce any high or low spots on the handle 30.
10. Rinsing and/or dusting the handle 30 to remove any dust, dirt, grease, or other unwanted byproducts created from step 9, if needed.
11. Finishing the handle 30 by performing the following sub-steps:
    a. Preparing additional resin 50.
    b. Applying the first finishing layer of resin to the handle 30 in the same manner as described above.
    c. Curing the first finishing layer of resin, in the same manner as described above.
12. Step 11 may be repeated one or more times, with the handle 30 being roughed by fine sand paper or steel wool before each repetition. Different resins 50 may be used during the repetition(s) of step 11. In the preferred embodiment, step 11 is performed three times, with the second and third iterations using West System™ Epoxy 105/207 for the finishing resin layers.

At any time in the above described process, the working end 22 of the core 20 of the flatware 10 may be buffed to provide it with a matte finish.

Modifications and variations can be made to the disclosed embodiments of the invention without departing from the subject or spirit of the invention as defined in the following claims.

I claim:

1. A method for creating decorative flatware, said flatware comprising a flatware core, having a shaft and a working end; and a handle, said handle comprised of a composite of inclusions and a resin, the inclusions being comprised of stone and/or shell, and said handle being formed over the shaft and fixedly attached thereto, said method comprising the steps of:

A. selecting inclusions to be used in the handle;

B. creating the handle by applying a first resin layer to the shaft of the flatware core; applying a first layer of inclusions onto the first resin layer, such that the inclusions bond to the core and become embedded at least in part within the resin and curing the first resin layer, whereupon the resin becomes rigid and the inclusions are fixedly attached thereto;

C. shaping the handle to its desired final shape; and

D. finishing the handle by applying a first finishing layer of resin to the handle and curing the first finishing layer of resin.

2. The method of claim 1, further comprising the step of cleaning the selected inclusions, said step to be performed after the step of selecting the inclusions and prior to the step of creating the handle.

3. The method of claim 2, wherein the selected inclusions comprise stone, and the step of cleaning the selected inclusions comprises one or more of the following: rinsing the stone with water; wiping the stone; and by blowing air over the stone.

4. A method for creating decorative flatware, said flatware comprising a flatware core, having a shaft and a working end; and a handle, said handle comprised of a composite of inclusions and a resin, the inclusions being comprised of shell, and said handle being formed over the shaft and fixedly attached thereto, said method comprising the steps of:

A. selecting inclusions to be used in the handle;

B. cleaning the selected inclusions, by physically separating shell material from non-shell material;

washing shell material with water;

sterilizing the shell material by applying one or more of the following to the shell material: bleach; ammonia; and commercial cleaning solvent; and drying the shell material, by one of the following methods: heat drying in an oven; heat drying by heat lamps; heated air drying; and unheated air drying;

C. creating the handle by applying a first resin layer to the shaft of the flatware core;

applying a first layer of inclusions onto the first resin layer, such that the inclusions bond to the core and become embedded at least in part within the resin; and curing the first resin layer, whereupon the resin becomes rigid and the inclusions are fixedly attached thereto;

D. shaping the handle to its desired final shape; and

E. finishing the handle by applying a first finishing layer of resin to the handle and curing the first finishing layer of resin.

5. The method of claim 4, further comprising the step of reducing the inclusions to particulates, said step to be performed after the step of selecting the inclusions and prior to the step of creating the handle.

6. The method of claim 5, wherein the step of reducing the inclusions to particulates comprises manually crushing the inclusions with hammers, mauls, or mortar and pestle, or mechanically crushing the inclusions using stone crushers or grinders; and screening the particulates for desired size by passing them through screens or sieves.

7. The method of claim 5, further comprising the step of covering the working end of the core with a removable protective material, said step to be performed prior to the step of creating the handle.

8. The method of claim 4, further comprising the step of covering the working end of the core with a removable protective material, said step to be performed prior to the step of creating the handle.

9. The method of claim 4, wherein the step of creating the handle comprises applying a first resin layer to the shaft of the flatware core;

applying inclusions previously reduced to particulates onto the first resin layer to create a first particulate layer, such that the first particulate layer bonds to the shaft and the particulates thereof become embedded at least in part within the resin; and curing the first resin layer, whereupon the first resin layer becomes rigid and the particulates are fixedly attached thereto, with the handle comprised of the first resin layer and particulates and having an outer surface.

10. The method of claim 9, wherein the step of creating the handle further comprises performing the following sequence of steps, said sequence of steps following the steps set forth in claim 9:

applying a final resin layer to the handle, whereupon the final resin layer substantially covers any particulates extending beyond the outer surface of the handle, such that gaps, crevices, or cracks formed into the outer surface of the handle are filled in by the final resin layer; and curing the final resin layer, whereupon the final resin layer becomes rigid and a substantially smooth outer surface of the handle results.

11. The method of claim 4, wherein the step of shaping the handle comprises one or more of the following steps: coarsely sanding the handle; finely sanding the handle; grinding the handle; and cutting the handle.

12. The method of claim 4, further comprising the step of buffing the working end of the flatware core to provide it with a matte finish.

13. A method for creating decorative flatware, said flatware comprising a flatware core, having a shaft and a working end; and a handle, said handle comprised of a composite of inclusions and a resin, the inclusions being comprised of stone and/or shell, and said handle being formed over the shaft and fixedly attached thereto, said method comprising the steps of:

A. selecting inclusions to be used in the handle;

B. creating the handle by: applying a first resin layer to the shaft of the flatware core by performing one or more of the following substeps: applying the first resin layer to the shaft by a brush, spraying the first resin layer onto the shaft, and dipping the shaft into the resin; applying inclusions previously reduced to particulates onto the first resin layer to create a first particulate layer, such that the first particulate layer bonds to the shaft and the particulates thereof become embedded at least in part within the resin; and curing the first resin layer, whereupon the first resin layer becomes rigid and the particulates are fixedly attached thereto, with the handle comprised of the first resin layer and particulates and having an outer surface;

C. shaping the handle to its desired final shape; and

D. finishing the handle by applying a first finishing layer of resin to the handle and curing the first finishing layer of resin.

14. A method for creating decorative flatware, said flatware comprising a flatware core, having a shaft and a working end; and a handle, said handle comprised of a composite of inclusions and a resin, the inclusions being comprised of stone and/or shell, and said handle being formed over the shaft and fixedly attached thereto, said method comprising the steps of:

A. selecting inclusions to be used in the handle;

B. creating the handle by: applying a first resin layer to the shaft of the flatware core; applying inclusions previously reduced to particulates onto the first resin layer to create a first particulate layer by performing one or more of the following substeps: distributing particulates onto the first resin layer by dropping them thereon, manually placing particulates onto the first resin layer, and rolling the shaft of the flatware core in the particulates, such that the first particulate layer bonds to the shaft and the particulates thereof become embedded at least in part within the resin; and curing the first resin layer, whereupon the first resin layer becomes rigid and the particulates are fixedly attached thereto, with the handle comprised of the first resin layer and particulates and having an outer surface;

C. shaping the handle to its desired final shape; and

D. finishing the handle by applying a first finishing layer of resin to the handle and curing the first finishing layer of resin.

15. A method for creating decorative flatware, said flatware comprising a flatware core, having a shaft and a working end; and a handle, said handle comprised of a composite of inclusions and a resin, the inclusions being comprised of stone and/or shell, and said handle being formed over the shaft and fixedly attached thereto, said method comprising the steps of:

A. selecting inclusions to be used in the handle;

B. creating the handle by applying a first resin layer to the shaft of the flatware core; applying inclusions previously reduced to particulates onto the first resin layer to create a first particulate layer, such that the first particulate layer bonds to the shaft and the particulates thereof become embedded at least in part within the resin; curing the first resin layer, whereupon the first resin layer becomes rigid and the particulates are fixedly attached thereto, with the handle comprised of the first resin layer and particulates and having an outer surface; and performing the following sequence of steps one or more times: applying an intermediate resin layer to the handle, applying inclusions previously reduced to particulates onto the intermediate resin layer to create an intermediate particulate layer, such that the intermediate particulate layer bonds to and becomes embedded at least in part within the handle, and curing the intermediate resin layer, whereupon the intermediate resin layer becomes rigid and the particulates are fixedly attached thereto;

C. shaping the handle to its desired final shape; and

D. finishing the handle by applying a first finishing layer of resin to the handle and curing the first finishing layer of resin.

16. The method of claim 15, wherein the step of creating the handle further comprises performing the following sequence of steps, said sequence of steps following the steps set forth in claim 15:

applying a final resin layer to the handle, whereupon the final resin layer substantially covers any particulates extending beyond the outer surface of the handle, such that gaps, crevices, or cracks formed into the outer surface of the handle are filled in by the final resin layer; and curing the final resin layer, whereupon the final resin layer becomes rigid and a substantially smooth outer surface of the handle results.

17. A method for creating decorative flatware, said flatware comprising a flatware core, having a shaft and a working end; and a handle, said handle comprised of a composite of inclusions and a resin, the inclusions being comprised of stone and/or shell, and said handle being formed over the shaft and fixedly attached thereto, said method comprising the steps of:

A. selecting inclusions to be used in the handle;

B. creating the handle by applying a first resin layer to the shaft of the flatware core;

applying a first layer of inclusions onto the first resin layer, such that the inclusions bond to the core and become embedded at least in part within the resin and curing the first resin layer, whereupon the resin becomes rigid and the inclusions are fixedly attached thereto;

C. shaping the handle to its desired final shape; and

D. finishing the handle by applying a first finishing layer of resin to the handle; and curing the first finishing layer of resin;

and thereafter optionally performing the following sequence of steps one or more times:

roughing the handle by fine sand paper or steel wool;

applying a subsequent finishing resin layer to the handle; and curing the subsequent finishing resin layer, whereupon the handle achieves a substantially smooth outer surface.

18. The method of claim 17, whereby the handle is cleaned prior to the step of applying a first finishing resin layer to the handle.

19. The method of claim 17, further comprising the step of cleaning the selected inclusions, said step to be performed after the step of selecting the inclusions and prior to the step of creating the handle.

20. The method of claim 19, wherein the selected inclusions comprise stone, and the step of cleaning the selected inclusions comprises one or more of the following: rinsing the stone with water; wiping the stone; and by blowing air over the stone.

21. A method for creating decorative flatware, said flatware comprising a flatware core, having a shaft and a working end; and a handle, said handle comprised of a composite of inclusions and a resin, the inclusions being comprised of stone and/or shell, and said handle being formed over the shaft and fixedly attached thereto, said method comprising the steps of:

A. selecting inclusions to be used in the handle;

B. cleaning the selected inclusions;

C. reducing the inclusions to particulates;

D. covering the working end of the flatware core with tape, foil, plastic, or other removable protective material;

E. creating the handle by performing the following sequence of steps:

performing the following sequence of steps one time:

applying a first resin layer to the shaft of the flatware core, applying particulates onto the first resin layer to create a first particulate layer such that the first particulate layer bonds to the shaft and the particulates thereof become embedded at least in part within the first resin layer, and curing the first layer of resin, whereupon the resin becomes rigid and the inclusions are fixedly attached thereto;

performing the following sequence of steps zero or more times:

applying an intermediate resin layer to the handle, applying particulates onto the intermediate resin layer to create an intermediate particulate layer such that the intermediate particulate layer bonds to and becomes embedded at least in part within the handle, and curing the intermediate resin layer, whereupon the intermediate resin layer becomes rigid and the particulates are fixedly attached thereto; and performing the following sequence of steps zero or more times:

applying a final resin layer to the handle, whereupon the final resin layer substantially covers any particulates extending beyond the outer surface of the handle such that gaps, crevices, or cracks formed into the outer surface of the handle are filled in by the final resin layer, and curing the final resin layer, whereupon the final resin layer becomes rigid and a substantially smooth outer surface of the handle results;

F. shaping the handle to its desired final shape;

G. finishing the handle by performing the following sequence of steps:

applying a first finishing layer of resin to the handle, and curing the first finishing layer of resin; and performing the following sequence of steps zero or more times: roughing the handle by fine sand paper or steel wool, applying a subsequent finishing layer of resin to the handle, and curing the subsequent finishing layer of resin;

H. removing the protective material from the working end of the flatware core; and I. buffing the working end of the flatware core to provide it with a matte finish.

* * * * *